US005095337A

United States Patent [19]

Yamaguchi

[11] Patent Number: 5,095,337

[45] Date of Patent: Mar. 10, 1992

[54] ELECTROPHOTOGRAPHIC APPARATUS HAVING A MOVABLE SELF-SCANNER

[75] Inventor: Yasuyoshi Yamaguchi, Shizuoka, Japan

[73] Assignee: Tokyo Electric Co., Ltd., Tokyo, Japan

[21] Appl. No.: 618,876

[22] Filed: Nov. 28, 1990

[30] Foreign Application Priority Data

Dec. 6, 1989 [JP] Japan ..... 1-316943

[51] Int. Cl.[5] ..... G03G 15/04

[52] U.S. Cl. ..... 355/229; 355/210; 355/233; 361/214

[58] Field of Search ..... 355/229, 228, 233, 210, 355/219, 232, 1, 200, 202; 361/212, 214; 350/96.15, 96.16, 3.69, 3.71

[56] References Cited

U.S. PATENT DOCUMENTS

| | | | |
|---|---|---|---|
| 4,535,341 | 8/1985 | Kun et al. | 346/107 R |
| 4,727,380 | 2/1988 | Miura et al. | 355/1 X |
| 4,767,172 | 8/1988 | Nichols et al. | 355/1 X |
| 4,864,364 | 9/1989 | Ogino et al. | 355/202 |

OTHER PUBLICATIONS

Proceeding of the SID, vol. 2S/1, 1987, Z. K. Kun et al.; "TFEL Edge Emitter Array for Optical Image Bar Applications.", pp. 81-85.

Journal of Imaging Technology, vol. 14, No. 1, Feb. 1988, "Construction and Characterization of 12-in. Long TFEL Edge Emitter Eraser Bar for Electrophotographic Applications", D. Leksell, et al.

The Construction and Characterization of a 400 Lines-Per-Inch TFEL Edge Emitter, D. Leksell, et al.

Test Station For Thin Film Electroluminescent (TFEL) Edge Emitter Array, A Potential Low-Cost, All Solid State Imaging Device, Zoltan K. Kun et al., Westinghouse R&D Center, Dec. 16, 1987, pp. 1-16.

*Primary Examiner*—A. T. Grimley
*Assistant Examiner*—Sandra L. Brase
*Attorney, Agent, or Firm*—Oblon, Spivak, McClelland, Maier & Neustadt

[57] ABSTRACT

An electrophotographic apparatus is provided with a self-scanning exposure device comprising a case having a shape substantially resembling the letter L, a linear light emitting head formed by linearly arranging a plurality of light emitting elements and disposed in one section of the case, and a printed wiring board having a driving circuit for driving the linear light emitting head and disposed in the other section of the case. The substantially L-shaped case containing the components of the self-scanning exposure device requires a space having a relatively small size with respect to the radial direction of photoconductive means for installation, so that the electrophotographic apparatus can be formed in a compart construction.

8 Claims, 5 Drawing Sheets

ELECTROPHOTOGRAPHIC APPARATUS HAVING A MOVABLE SELF-SCANNER

FIELD OF THE INVENTION AND RELATED ART STATEMENT

The present invention relates to an electrophotographic apparatus which develops an electrostatic latent image formed on a photoconductive body, and transfers the developed image to a recording medium for printing.

Such an electrophotographic apparatus forms an electrostatic latent image on the photoconductive body by charging the outer circumference of the photoconductive body by the charging device and irradiating the charged outer circumference of the photoconductive body with a light beam by the exposure device. Generally, the conventional electrophotographic apparatus employs a deflection scanning exposure device having a polygonal rotating mirror to deflect a light beam emitted by a light source, such as a laser diode, for scanning the outer circumference of the photoconductive body.

Recently, a self-scanning exposure device has been developed. The self-scanning exposure device employs a linear light emitting head formed by linearly arranging a plurality of end emission EL (electroluminescent) elements each formed by sandwiching an active thin film, such as a thin film of zinc sulfide containing an active element, between dielectric films, and attaching a pair of electrodes respectively to the dielectric films. Voltage is applied across the individual EL elements of the linear light emitting head to project light through the end surfaces of the individual EL elements on the photoconductive body for exposure. Since the light path of the self-scanning exposure device is shorter than that of the deflection scanning device, the self-scanning exposure device can be formed in a compact construction as compared with the deflection scanning device.

The linear light emitting head and the driving circuit for driving the linear light emitting head of such a known self-scanning exposure device employing end emission EL elements are arranged on a comparatively long substrate, and the end emission EL elements emit light along the longitudinal direction of the substrate. Accordingly, the self-scanning exposure device requires a relatively long space extending radially with respect to the center of the photoconductive body for installation, which increases the overall size of the electrophotographic apparatus even if the self-scanning exposure device is formed in a compact construction.

The focal length of the linear light emitting head of the self-scanning exposure device is very short, and hence the allowable range of scatter of distances between the surface of the photoconductive body and the component EL elements is very narrow. Nevertheless, since the photoconductive body and exposure device of the conventional electrophotographic apparatus are mounted respectively on separate support members, errors in the respective positions of the support members relative to each other increase errors in the respective positions of the light emitting elements relative to the photoconductive body, so that it is difficult to adjust the position of the linear light emitting head relative to the photoconductive body accurately and, consequently, the light emitting elements of the linear light emitting head cannot be correctly disposed at a distance corresponding to the focal length from the photoconductive body, which results in irregular illumination of the photoconductive body.

Various positioning methods of positioning the self-scanning exposure device have been proposed. A positioning method fixes the self-scanning exposure device after positioning the self-scanning exposure device by using a thickness gage, and another positioning method employs disks rotatably attached to the opposite ends of the self-scanning device, positions the self-scanning exposure device with the disks in contact with the circumference of the photoconductive body, and then fixes the self-scanning exposure device. The former method using the thickness gage may possibly damage the light projecting surface of the self-scanning exposure device or the image forming layer of the photoconductive body, and the latter method using the disks may possibly cause the transmission of vibrations of the photoconductive body to the self-scanning exposure device to disturb the scanning lines, so that it is impossible to from an image correctly. Thus, either method is not perfectly satisfactory.

OBJECT AND SUMMARY OF THE INVENTION

It is a first object of the present invention to provide an electrophotographic apparatus of a compact construction.

A second object of the present invention is to provide an electrophotographic apparatus provided with a linear light emitting head capable of being securely connected to a substrate.

A third object of the present invention is to provide an electrophotographic apparatus having an exposure device which can be accurately positioned relative to a photoconductive body.

A fourth object of the present invention is to provide an electrophotographic apparatus in which an exposure device can be readily positioned relative to a photoconductive body without deteriorating the image forming function of the related components.

To achieve the objects, the present invention employs a self-scanning exposure device comprising a linear light emitting head disposed in one section of a case having a shape substantially resembling the letter L in cross section and comprising a plurality of light emitting elements for illuminating a charged photoconductive body to form an electrostatic latent image on the photoconductive body, a substrate having a linear light emitting head driving circuit and disposed in the other section of the case, and a flexible cable interconnecting the linear light emitting head and the driving circuit of the substrate. Contained in the L-shaped case, the self-scanning exposure device is small in size with respect to the radial direction of the photoconductive body, which enables the electrophotographic apparatus to be formed in a compact construction.

The opposite ends of the flexible cable are held between the wall of the case and the linear light emitting head and between the wall of the case to maintain the secure connection of the flexible cable to the linear light emitting head and the driving circuit of the substrate.

The exposure device and the photoconductive body, such as a photoconductive drum, are mounted on a single supporting unit to reduce errors in the relative positions of the photoconductive body and the exposure device in assembling the photoelectric apparatus.

A stopper is attached to the case of the exposure device so as to be moved toward and away from the photoconductive body and so as to be fixed at an optional position or reference faces are formed on the opposite ends of the case of the exposure device for gap adjustment with a thickness gage to enable readily the adjustment of the distance between the photoconductive body and the extremity of the exposure device without deteriorating the image forming function of the related component parts.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
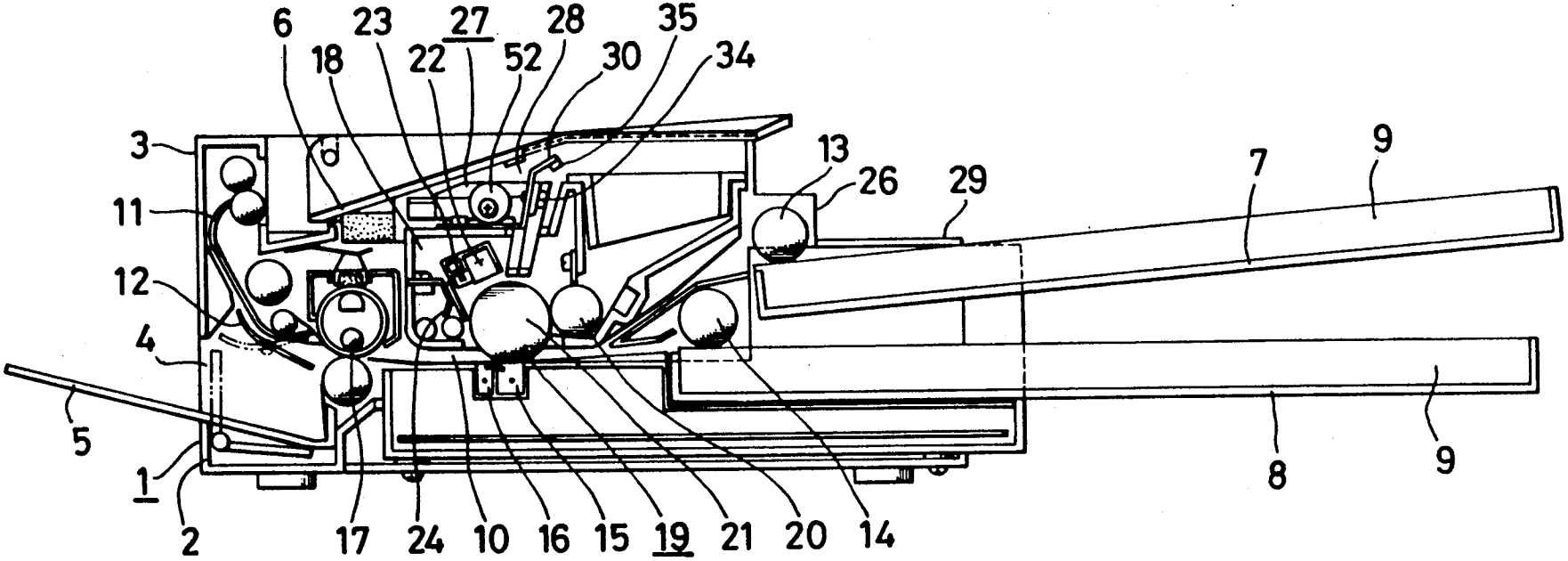
FIG. 1 is a longitudinal sectional view of an electrophotographic apparatus in a preferred embodiment according to the present invention incorporating a self-scanning exposure device.
Figure 2:
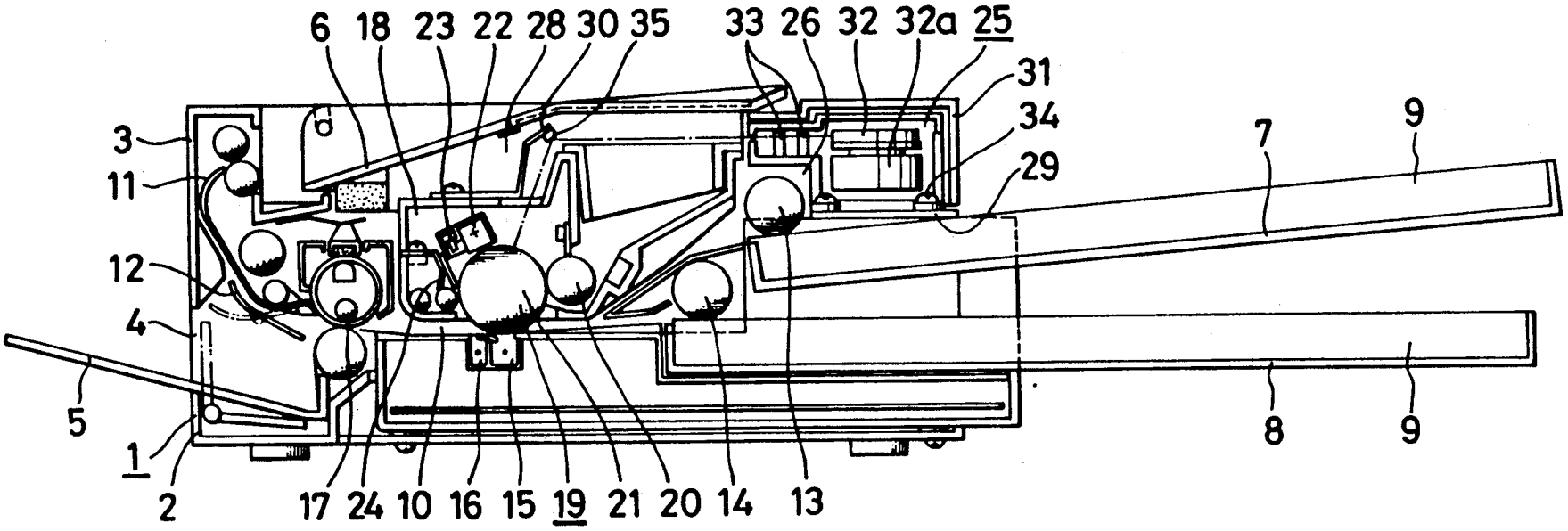
FIG. 2 is a longitudinal sectional view of an electrophotographic apparatus in another embodiment according to the present invention incorporating a deflection scanning exposure device.

Referring to FIGS. 1 and 2, an electrophotographic apparatus in a preferred embodiment according to the present invention has a housing 1 formed by joining a base cover 2 and an upper cover 3. A first delivery tray 5 is mounted detachably on the rear end of the housing 1 near an opening 4. A second delivery tray 6 is hinged detachably to the upper wall of the upper cover 3. A sheet transporting path 10 is formed in the case 1 to transport a sheet 9 delivered from either a sheet feed cassette 7 or a sheet feed cassette 8. A sheet delivery path 11 is connected to one end of the sheet transporting path 10 to deliver the sheet 9 to the second delivery tray 6. A guide member 12 is provided pivotally at the junction of the sheet transporting path 10 and the sheet delivery path 11 to guide the sheet 9 into the sheet delivery path 11 or toward the first delivery tray 5. Feed rollers 13 and 14 in contact with the respective uppermost sheets 9 of the sheet feed cassettes 7 and 8, a transfer unit 15 for transferring a developed image from a photoconductive drum 21 to the sheet 9, a static eliminator 16 for eliminating static charge remaining on the sheet 9, and a fixing unit 17 for fixing the developed image to the sheet 9 are arranged sequentially in that order along the sheet transporting path 10.

Figure 7:
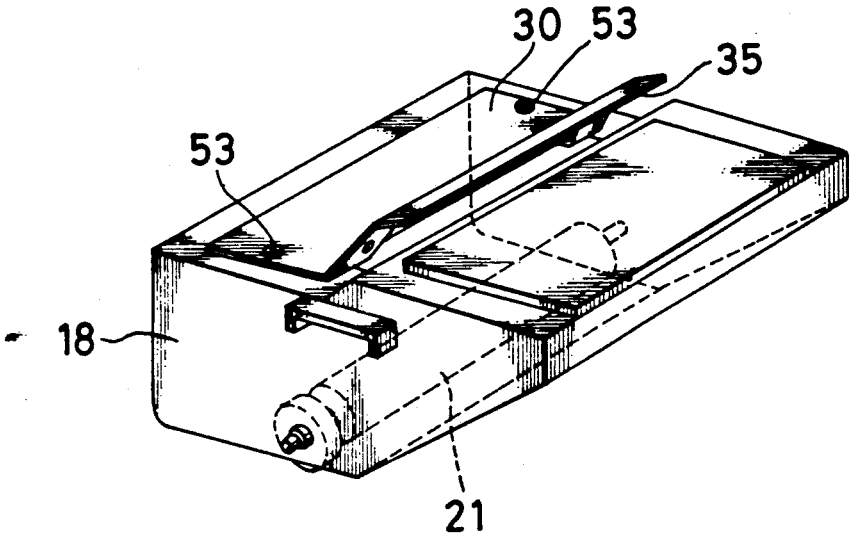
FIG. 7 is a perspective view of a supporting unit.
Figure 8:
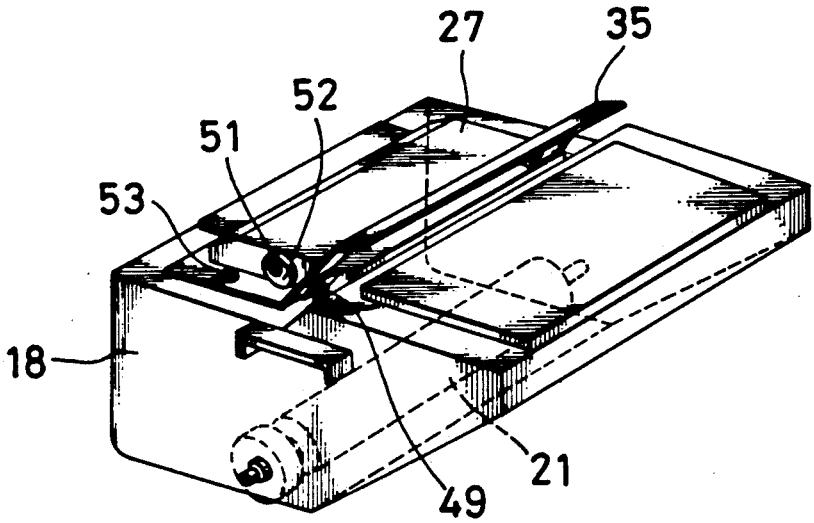
FIG. 8 is a perspective view of the self-scanning exposure device as supported on the supporting member.

A supporting structure 18 as shown in FIG. 7 is disposed within the housing 1. A photoconductive unit 19 and a developing unit 20 are held within the supporting structure 18. The photoconductive unit 19 comprises the photoconductive drum 21 journaled on the opposite side walls of the supporting structure 18, a charging unit 22 for charging the photoconductive drum 21, a static eliminator 23 for leveling the charge on the circumference of the photoconductive drum 21 by illumination, and a cleaning unit 24 for removing residual developer from the photoconductive drum 21. The developing unit 20 develops an electrostatic latent image by applying a developer to the circumference of the photoconductive drum 21. The developer is charged in a polarity so that the developer adheres only to the electrostatic latent image formed on the circumference of the photoconductive drum 21.

The housing 1 has a first housing chamber 26 for containing a deflection scanning exposure device 25 above the sheet feed cassette 7, and a second housing chamber 28 for containing a self-scanning exposure device 27. A base plate 29 to be mounted with the deflection scanning exposure device 25 is provided fixedly within the first housing chamber 26. The second housing chamber 28 is formed above the supporting structure 18. Referring to FIG. 7, the supporting structure 18 has a base plate 30 for supporting the self-scanning exposure device 27, extending toward the second housing chamber 28. A reflecting mirror 35 for deflecting a laser beam emitted by the deflection scanning exposure device 25 toward the photoconductive drum 21 is attached to the base plate 30.

As shown in FIG. 2, the deflection scanning exposure device 25 comprises a light source, not shown, such as a laser diode, a motor 32*a*, a polygonal rotating mirror 32 attached to the output shaft of the motor 32*a*, an $f\theta$ lens 33 and a frame 31 supporting these components. The frame 31 is fastened, when necessary, to the base plate 29 with screws 34. The deflection scanning exposure device 25 deflects a laser beam emitted by the light source by the polygonal rotating mirror 35, condenses the laser beam by the $f\theta$ lens 33, and then deflects the laser beam by the reflecting mirror 35 toward the photoconductive drum 21.

Figure 3:
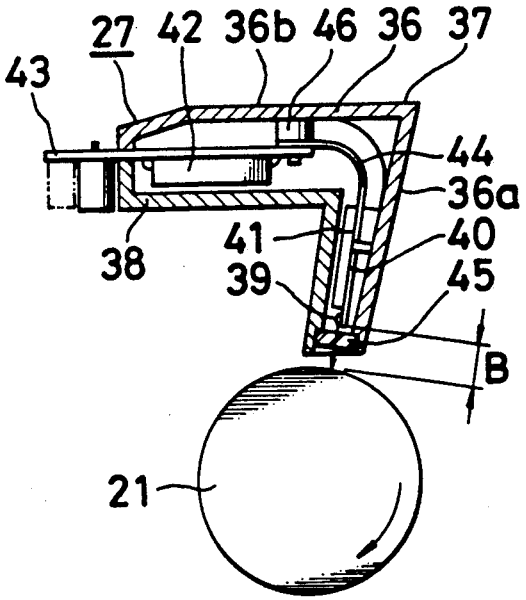
FIG. 3 is a longitudinal sectional view of the self-scanning exposure device.
Figure 6:
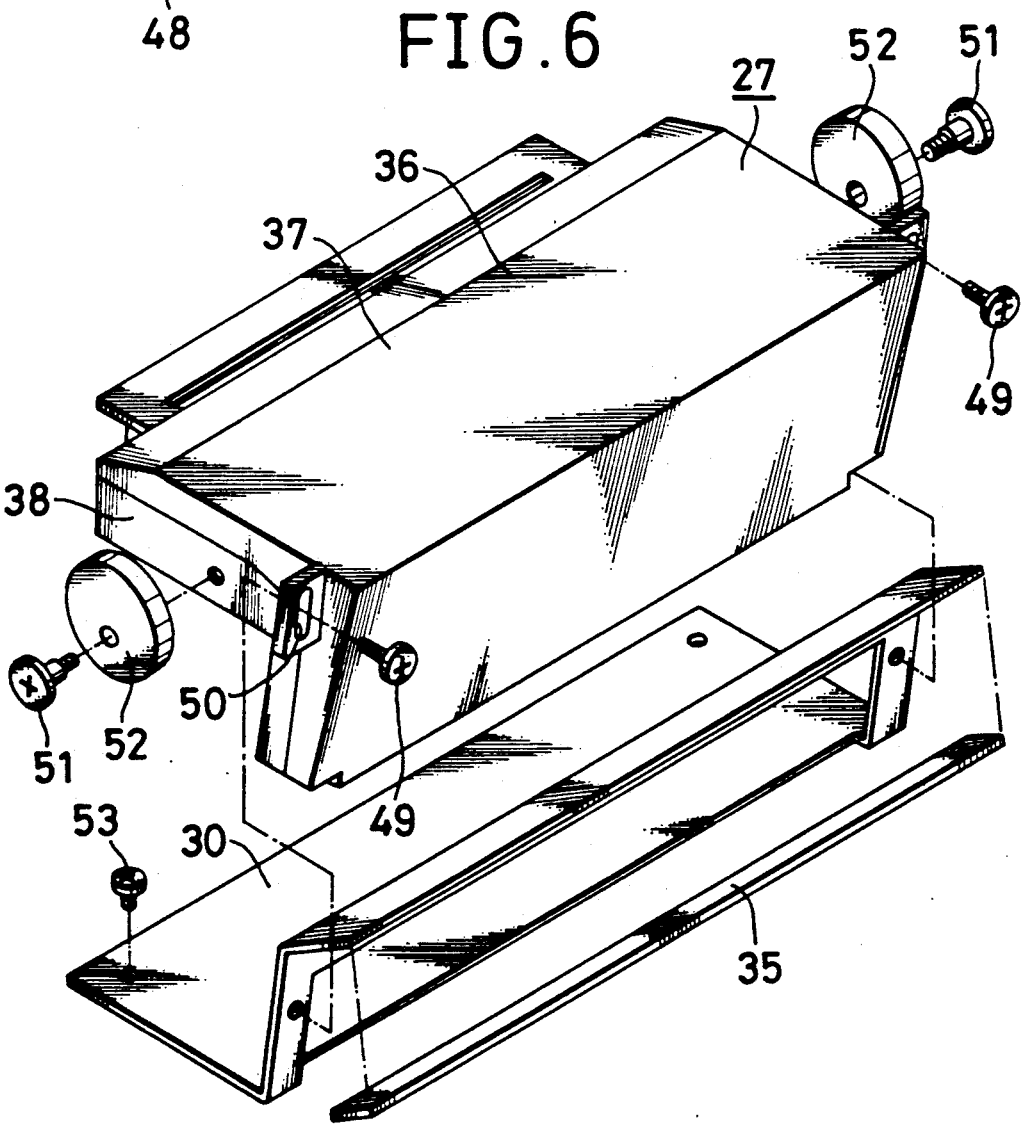
FIG. 6 is an exploded perspective view of a supporting structure for supporting the self-scanning exposure device.

As shown in FIG. 1, the self-scanning exposure device 27 is fastened, when necessary, to the base plate 30 with screws 34. As shown in FIG. 3, the self-scanning exposure device 27 comprises a linear light emitting head 40 formed by arranging a plurality of end emission EL elements 39, i.e., light emitting elements, on a substrate 41, a printed wiring board 43 provided with a driving circuit 42 for driving the linear light emitting head 40, a flexible cable 44 for electrically connecting the linear light emitting head 40 and the printed wiring board 43, a synthetic resin case 36 having a cross section of a shape substantially resembling the letter L and fixedly holding these components, and a lens 45 adhesively fixed to the extremity of the case 36. The linear light emitting head 40 is contained in one section 36*a* of the case 36 so as to extend in parallel to scanning lines on the photoconductive drum 21. The printed wiring board 43 is contained in the other section 36*b* of the case 36 in a substantially horizontal position. The case 36 is constructed by joining the mating surfaces of two split case members 37 and 38 and welding together the split case members 37 and 38. The lens 45 is attached adhesively to the case 36 after thus assembling the same. The linear light emitting head 40 and the printed wiring board 43 are positioned and fastened to projections 46 formed on the case member 37. The opposite ends of the flexible cable 44 are held between the linear light emitting head 40 and the corresponding projection 46 and between the printed wiring board 43 and the corresponding projection 46, respectively to facilitate the fabrication of the case 36. As shown in FIG. 6, the case 36 has on its opposite sides lugs provided with vertical slots 50. The case 36 is fastened to the base plate 30 by screwing screws 49 through the slots 50 in threaded holes formed in the base plate 30. Eccentric disks 52 are fastened respectively to the opposite sides of the case 36 with screws 51. The base plate 30 is fastened to the supporting structure 18 with screws 53.

During full rotation of the photoconductive drum 21, the charging unit 22 charges the circumference of the photoconductive drum 21, the deflection scanning exposure device 25 or the self-scanning exposure device 27 scans the charged circumference of the photoconductive drum 21 to form an electrostatic latent image on the circumference of the photoconductive drum 21, and the developing unit develops the electrostatic latent image in a visible image. On the other hand, the sheet 9 fed by the feed roller 13 from the sheet feed cassette 7 or by the feed roller 14 from the sheet feed cassette 8 is delivered to the photoconductive drum 21, the visible image is transferred from the photoconductive drum 21 to the sheet 9 by the agency of the transfer unit 15, the visible image is fixed to the sheet 9 by the fixing unit 17, and then the sheet is delivered to the delivery tray 5 or 6 depending on the position of the guide member 12.

Having a relatively short optical path, the self-scanning exposure device 27 requires a relatively small space for installation in the housing 1. Since the printed wiring board 43 mounted with the driving circuit 42, and the linear light emitting head 40 are disposed at an acute angle to each other to form the self-scanning exposure device 27 in a relatively small height, the housing 1 may be formed in a relatively small height. Having opposite ends held firmly on the projections 46, the secure connection of the flexible cable 44 to the linear light emitting head 40 and the printed wiring board 43 is maintained.

The deflection scanning exposure unit 25 having a relatively long optical path can be disposed in an unutilized space over the sheet feed cassette 7 and hence the housing 1 need not be formed in a large size.

Figure 4:
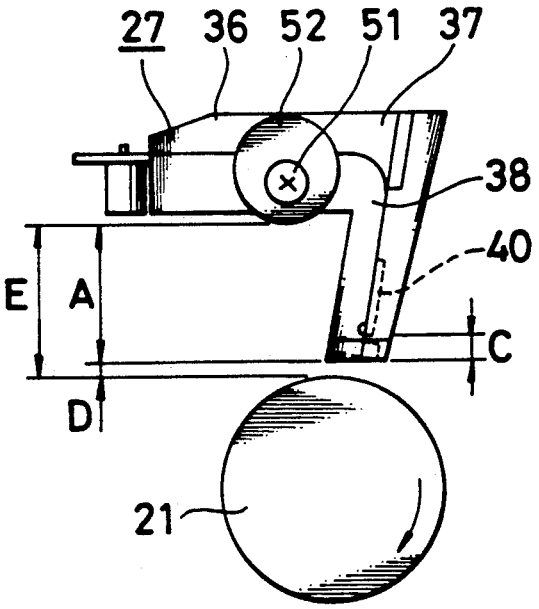
FIG. 4 is a side elevation of the self-scanning exposure device.
Figure 5:
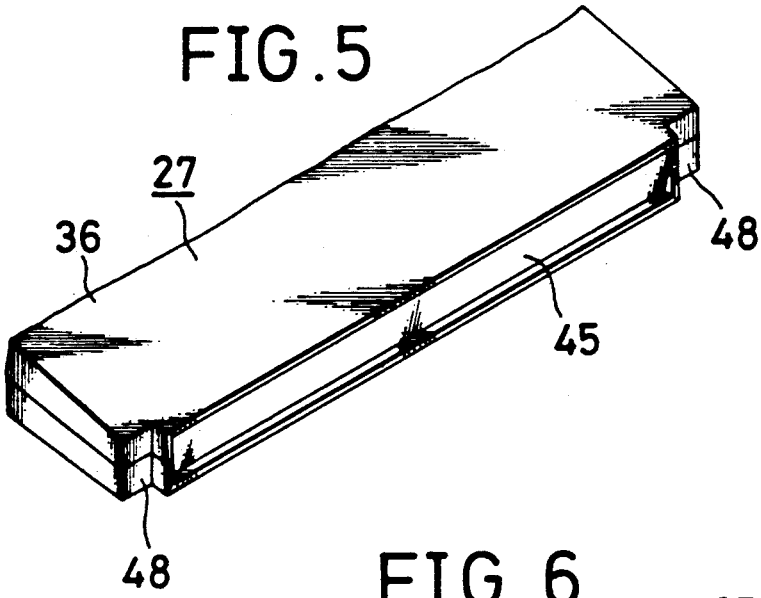
FIG. 5 is a perspective view of the front portion of the self-scanning exposure device.

A manner of adjusting the optical path length of the self-scanning exposure device 27 will be described hereinafter. The angular position of each the eccentric disks 52 is adjusted by means of a jig, not shown, before incorporating the self-scanning exposure device 27 into the housing 1. The jig has first reference surfaces to be in contact with the eccentric disks 52, and second reference surfaces to be in contact with the extremity of the case 36. The distance between the first reference surfaces and the corresponding second reference surfaces is fixed. The jig is combined with the self-scanning exposure device 27 with the first reference surfaces in contact with the eccentric disks 52, the screws 51 are loosened, the eccentric disks 52 are turned so that the second reference surfaces of the jig are brought into contact with the extremity of the case 36, and then the screws 51 are fastened to fix the eccentric disks 52 in place. Thus, the distance between a portion of the circumference of each eccentric disk 52 to be in contact with the base plate 30 and the extremity of the case 36 is adjusted to a predetermined distance A (FIG. 4). Suppose that the focal length of the linear light emitting head 40 is B (FIG. 3), the distance between the end emission EL elements 39 and the extremity of the case 36 is C, the distance between the extremity of the case 36 and the circumference of the photoconductive drum 21 is D, and the distance between the circumference of each eccentric disk 52 and the circumference of the photoconductive drum 21 is E (FIG. 4). Then, $D=B-C$. Since the linear light emitting head 40 is positioned by the projection 46, the distance C is accurate, and hence the focal lengths B of the light emitting EL elements 39 can be uniformly adjusted. Since the distance between the circumference of each eccentric disk 52 and the extremity of the case 36 is adjusted accurately to the distance A by means f the jig, the distance between the extremity of the case 36 and the circumference of the photoconductive drum 21 can be accurately adjusted to the distance D ($=E-A$) as shown in FIG. 4 simply by disposing the self-scanning exposure device 27 with the circumferences of the eccentric disks 52 in contact with the base plate 30 and screwing the screws 34 through the slots 50 in the base plate 30. Such adjustment can be achieved without touching the photoconductive drum 21.

The distance between the extremity of the case 36 and the photoconductive drum 21 may be adjusted to the distance D by turning the eccentric disks 52 while the distance between the reference faces 48 formed on the opposite sides of the case 36 and the circumference of the photoconductive drum 21 is measured with a thickness gage after mounting the self-scanning exposure unit 27 on the base plate 30 instead of adjusting the same by using the jig before mounting the self-scanning exposure device 27 on the base plate 30. Since the reference faces 48 are positioned outside the lens 45, the lens 45 and the image forming area of the photoconductive drum 21 are never damaged with the thickness gage. Disposed closely to the circumference of the photoconductive drum 21 with a gap of a size equal to the distance D therebetween, the vibration of the photoconductive drum 21 is not transmitted to the self-scanning exposure device 27.

Since the supporting structure 18 for holding the photoconductive drum 21 is provided with the base plate 30 for holding the self-scanning exposure device 27, the self-scanning exposure device 27 can be accurately positioned relative to the photoconductive drum 21 and hence the circumference of the photoconductive drum 21 can be uniformly scanned by light beams.

What is claimed is:

1. An electrophotographic apparatus comprising:

a photoconductive means;

a self-scanning exposure device defining a substantially L-shaped case, said case comprising first and second sections, a linear light emitting head having a plurality of light emitting elements being mounted within said case in one of said first and second sections of said case and being capable of forming an electrostatic latent image on the photoconductive means by irradiating the charged photoconductive means with light, a printed wiring board being mounted on the other of said first and second sections of said case, said printed wiring board being provided with a driving circuit for driving the linear light emitting head, said driving circuit being mounted within said case in the other of said first and second sections of said case, a connecting means being deposed within said case and interconnecting the linear light emitting head and the printed wiring board;

a developing unit for developing the electrostatic latent image formed on the photoconductive means in a visible image by applying a developer to the electrostatic latent image;

a transfer unit for transferring the visible image from the photoconductive means to a recording medium;

a static eliminator for eliminating charge from the photoconductive means; and a fixing unit disposed after the transfer unit with respect to the direction of transportation of the recording medium on a recording medium transporting path.

2. An electrophotographic apparatus according to claim 1, wherein the connecting means interconnecting the linear light emitting head and the printed wiring board is a flexible cable, and the opposite ends of the flexible cable is held securely between the linear light emitting head and the wall of the case and between the printed wiring board and the wall of the case, respectively.

3. An electrophotographic apparatus according to claim 2, wherein the case of the self-scanning exposure device consists of two split case members each having a shape substantially resembling the letter L, and the split case members are welded together to form the case after positioning the linear light emitting head and the printed wiring board on projections formed in both the split case members or either of the two split case members with the opposite ends of the flexible cable held between the linear light emitting head and the corresponding projection and between the printed wiring board and the corresponding projection, respectively.

4. An electrophotographic apparatus according to claim 1, wherein the photoconductive means and the self-scanning exposure device are supported on a single supporting structure.

5. An electrophotographic apparatus according to claim 1, wherein the self-scanning exposure device is held on a base so as to be moved toward and away from the photoconductive means, and the case of the self-scanning exposure device is provided with adjusting means capable of moving the case toward and away from the photoconductive means and capable of being fixed in an optional position.

6. An electrophotographic apparatus according to claim 5, wherein the adjusting means comprises eccentric disks capable of fastened to the case of the self-scanning exposure device with screws at an optional angular position.

7. An electrophotographic apparatus according to claim 1, wherein the self-scanning exposure device is held on a base so as to be moved toward and away from the photoconductive means, and reference faces are formed on the opposite sides of the case of the self-scanning exposure device at a predetermined position relative to the light emitting elements of the linear light emitting head so as to be positioned opposite to the outer circumference of the photoconductive means with a gap of a predetermined size therebetween.

8. An electrophotographic apparatus according to claim 1, wherein said first and second sections of said case define an acute angle.

* * * * *